US009599951B2

(12) United States Patent
Yamaguchi et al.

(10) Patent No.: US 9,599,951 B2
(45) Date of Patent: Mar. 21, 2017

(54) ROLLER, IMAGE FORMING APPARATUS AND MANUFACTURING METHOD OF CYLINDRICAL SHAFT

(71) Applicant: CANON KABUSHIKI KAISHA, Tokyo (JP)

(72) Inventors: Noritomo Yamaguchi, Kawasaki (JP); Yoichiro Iizuka, Hanoi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 128 days.

(21) Appl. No.: 14/607,363

(22) Filed: Jan. 28, 2015

(65) Prior Publication Data

US 2015/0220046 A1 Aug. 6, 2015

(30) Foreign Application Priority Data

Jan. 31, 2014 (JP) ..... 2014-017263

(51) Int. Cl.
*G03G 21/16* (2006.01)
*G03G 15/16* (2006.01)
(Continued)

(52) U.S. Cl.
CPC ..... *G03G 21/1604* (2013.01); *B21D 5/015* (2013.01); *B65H 5/062* (2013.01);
(Continued)

(58) Field of Classification Search
CPC ..... B21D 5/015; B65H 2402/70; G03G 2215/00679; G03G 2215/00367;
(Continued)

(56) References Cited

U.S. PATENT DOCUMENTS 1,387,199 A * 8/1921 Small ..... B21C 37/0815 138/171
1,872,276 A * 8/1932 Graham ..... B21C 37/0822 219/137 R
(Continued)

FOREIGN PATENT DOCUMENTS

JP 2008-265958 A 11/2008
JP 2012-121647 A 6/2012

*Primary Examiner* — Jason L Vaughan
(74) *Attorney, Agent, or Firm* — Fitzpatrick, Cella, Harper & Scinto

(57) ABSTRACT

A roller is provided includes a cylindrical shaft supported by a main assembly of an image forming apparatus or a detachable cartridge. The cylindrical shaft includes a separation region on a circumference of the cylindrical shaft, where a pair of end portions of the cylindrical shaft oppose each other or are in contact with each other with respect to a circumferential direction relative to the circumference of the cylindrical shaft, and wherein the separation region extends in an axial direction of the cylindrical shaft. In addition, a rotatable cylindrical member is mounted around an outer circumference of the cylindrical shaft and is rotatable about the cylindrical shaft while an inner peripheral surface of the rotatable cylindrical member is in contact with an outer peripheral surface of the cylindrical shaft in a region of the cylindrical shaft other than the separation region with respect to the circumferential direction.

19 Claims, 9 Drawing Sheets

(51) Int. Cl.
*B21D 5/01* (2006.01)
*B65H 5/06* (2006.01)

(52) U.S. Cl.
CPC ..... *G03G 15/1685* (2013.01); *G03G 21/1695* (2013.01); *B65H 2402/70* (2013.01); *B65H 2404/114* (2013.01); *B65H 2404/117* (2013.01); *G03G 2215/00679* (2013.01); *G03G 2215/0132* (2013.01); *Y10T 29/49544* (2015.01)

(58) Field of Classification Search
CPC ..... G03G 2215/00371; G03G 2215/00375; G03G 2215/00409; G03G 15/6555; G03G 15/6558; G03G 15/6552; G03G 15/6505; G03G 15/6529; B21C 37/065
USPC ..... 72/367.1, 368, 370.01; 492/16, 17, 18
See application file for complete search history.

(56) References Cited

U.S. PATENT DOCUMENTS 1,879,077 A * 9/1932 Carlsen ..... B21C 37/0822 72/347
1,879,078 A * 9/1932 Carlsen ..... B21C 37/0822 72/347
3,566,734 A * 3/1971 Robinson ..... B26F 1/384 493/60
3,683,734 A * 8/1972 Claussen ..... B23D 25/12 83/343
4,487,122 A * 12/1984 George ..... B41F 13/187 100/162 B
4,603,459 A * 8/1986 Buchanan ..... F16C 13/006 29/434
5,836,189 A * 11/1998 Streubel ..... B21C 37/065 72/51
5,842,962 A * 12/1998 Yamada ..... B23P 11/025 29/895.22
6,679,819 B1 * 1/2004 Holopainen ..... D21G 1/022 492/16
7,529,498 B2 * 5/2009 Kitagawa ..... F16C 13/02 399/100
7,637,135 B2 * 12/2009 Homig ..... B21C 37/065 72/367.1
7,934,304 B2 * 5/2011 McCall ..... F16L 9/17 138/145
8,602,549 B2 * 12/2013 Saito ..... B41J 13/076 271/275
8,959,973 B2 * 2/2015 Broβke ..... B21C 37/0815 72/368
9,388,005 B2 * 7/2016 Iizuka ..... B65H 9/004
2006/0115292 A1 * 6/2006 Sampe ..... G03G 15/0225 399/100
2010/0124445 A1 * 5/2010 Tanaka ..... G03G 15/657 399/308

* cited by examiner (a)

(b)

(a)

(b)

ROLLER, IMAGE FORMING APPARATUS AND MANUFACTURING METHOD OF CYLINDRICAL SHAFT

FIELD OF THE INVENTION AND RELATED ART

The present invention relates to a roller to be provided in an image forming apparatus.

Most of sheets of various rollers to be provided in the image forming apparatus such as a copying machine or a printer are formed of metal. As the metal shaft, a metal shaft having a solid structure is used in general, but Japanese Laid-Open Patent Application (JP-A) 2012-121647 discloses a technique using a metal shaft having a hollow structure molded by bending a metal plate shape for the purpose of reducing a weight and a material cost.

The shaft of the roller is required to be provided at an end portion or the like thereof with a portion-to-be-engaged for rotating the shaft and a rotation preventing portion for preventing rotation, so that there is a need to provide a step such as cutting or drawing for forming these portions. Further, the cylindrical shaft described in JP-A 2012-121647 is molded in a cylindrical shape by bending the metal plate so that end portions of the metal plate abut against each other, and therefore a gap or a stepped portion is liable to be formed along an axial direction between the end portions. Such a gap or stepped portion is not easily eliminated, and therefore in a constitution in which the cylindrical shaft slides with another member, there is a need to take a countermeasure such that the gap or the stepped portion is covered with a separate member so as not be adversely affected by a sliding property.

SUMMARY OF THE INVENTION

A principal object of the present invention is to provide a technique so as not to exert an influence on a sliding property by simplifying a structure of a roller having a cylindrical shaft.

According to an aspect of the present invention, there is provided a roller to be provided in a main assembly of an image forming apparatus or in a cartridge detachably mountable to the main assembly, the roller comprising: a cylindrical shaft supported by the main assembly or the cartridge, wherein the cylindrical shaft includes, in at least one position on a circumference thereof, a separation region where a pair of end portions thereof which oppose to or contact each other with respect to a circumferential direction, and wherein the separation region extends in an axial direction of the cylindrical shaft; and a rotatable cylindrical member mounted around an outer circumference of the cylindrical shaft, wherein the rotatable cylindrical member is rotatable about the cylindrical shaft while an inner peripheral surface thereof is press-contacted to an outer peripheral surface of the cylindrical shaft in a region other than the separation region with respect to the circumferential direction.

According to another aspect of the present invention, there is provided an image forming apparatus comprising: a cylindrical shaft supported by the main assembly or the cartridge, wherein the cylindrical shaft includes, in at least one position on a circumference thereof, a separation region where a pair of end portions thereof which oppose to or contact each other with respect to a circumferential direction, and wherein the separation region extends in an axial direction of the cylindrical shaft; a rotatable cylindrical member mounted around an outer circumference of the cylindrical shaft, wherein the rotatable cylindrical member is rotatable about the cylindrical shaft while an inner peripheral surface thereof is press-contacted to an outer peripheral surface of the cylindrical shaft with respect to the circumferential direction in a region other than the separation region; an urging member for urging the cylindrical shaft, wherein the separation region is in a position opposing the urging member with respect to the rotatable cylindrical member.

According to a further aspect of the present invention, there is provided a manufacturing method of a cylindrical shaft constituting a roller to be provided in a main assembly of an image forming apparatus or in a cartridge detachably mountable to the main assembly, wherein the cylindrical shaft includes, in at least one position on a circumference thereof, a separation region in which a pair of end portions thereof which oppose to or contact each other with respect to a circumferential direction, wherein the support extends in an axial direction of the cylindrical shaft, wherein a rotatable cylindrical member is rotatably mounted around an outer circumference of the cylindrical shaft, and wherein the cylindrical shaft further includes an engaging portion engageable with a rotation preventing portion provided in the main assembly or the cartridge, the manufacturing method comprising: a bending step of bending a metal plate, including a frame portion, a flat plate portion and a connecting portion connecting the frame portion and the flat plate portion, in a cylindrical shape at the flat plate portion; and a cutting step of separating the flat plate portion, molded in the cylindrical shape, from the frame portion while leaving a part of the connecting portion as the engaging portion at an end portion of the flat plate portion molded in the cylindrical shape.

These and other objects, features and advantages of the present invention will become more apparent upon a consideration of the following description of the preferred embodiments of the present invention taken in conjunction with the accompanying drawings.

DESCRIPTION OF THE EMBODIMENTS

Hereinbelow, embodiments of the present invention will be specifically described with reference to the drawings.

However, dimensions, materials and shapes of constituent elements and their relative arrangements and the like described in the following embodiments should be changed appropriately depending on structures and various conditions of apparatuses (devices) to which the present invention is applied. That is, the scope of the present invention is not intended to be limited to the following embodiments.

(Embodiment 1)

Embodiment 1 of the present invention will be described with reference to FIGS. 1-7. In the following embodiments of the present invention, as an electrophotographic image forming apparatus, a full-color image forming apparatus to which four process cartridges are detachably mountable is described as an example.

Incidentally, the number of process cartridges to be mounted in the image forming apparatus is not limited to four but may appropriately be set as desired.

For example, in the case of an image forming apparatus for forming a monochromatic image, the number of the process cartridges to be mounted in the image forming apparatus is one. Further, in the following description, as an example of the image forming apparatus, a printer is exemplified.

However, the image forming apparatus is not limited to the printer. The present invention is also applicable to, e.g., other image forming apparatuses such as a copying machine, a facsimile machine and a multi-function machine having functions of these machines is combination.

<Image Forming Apparatus>

Figure 2:
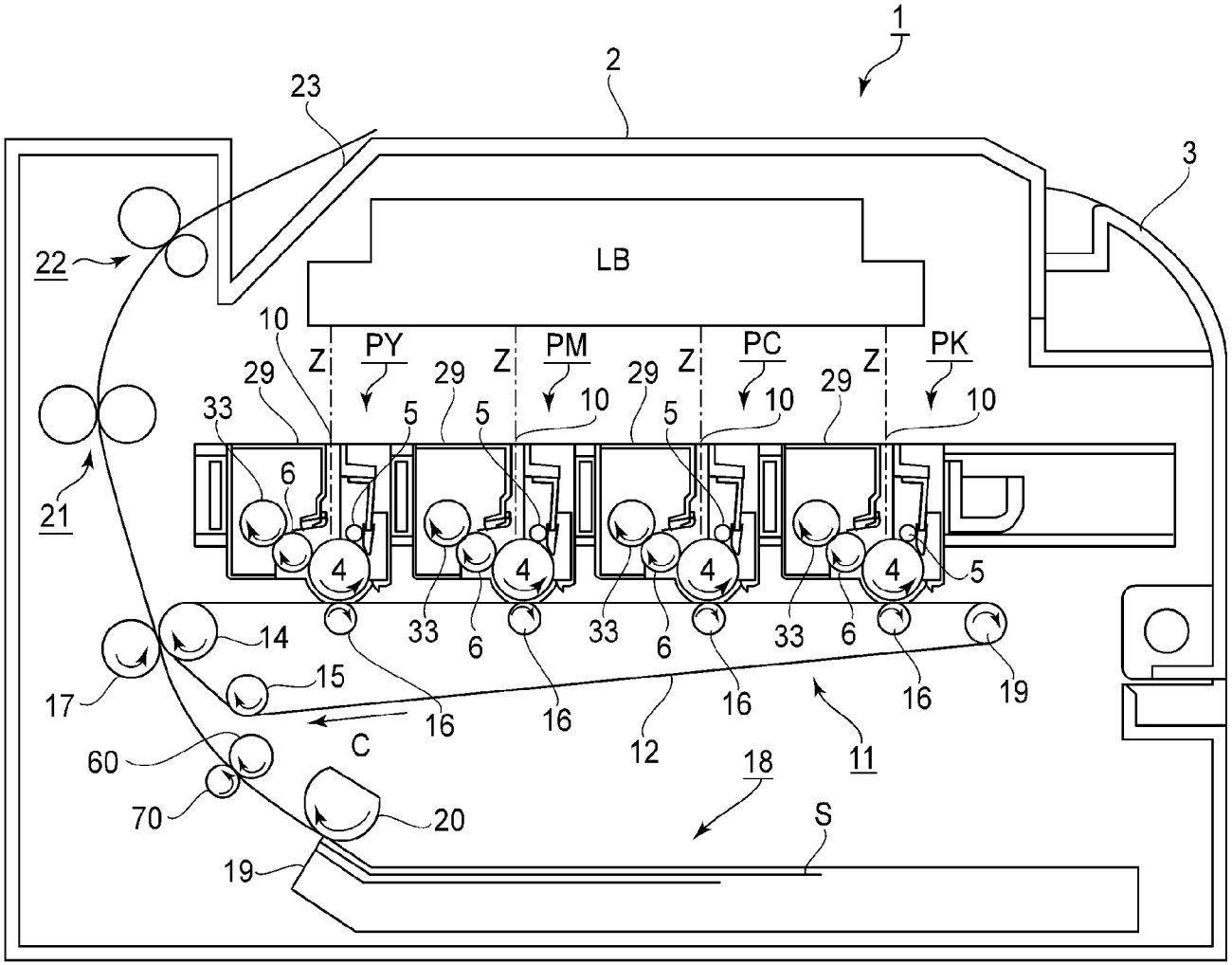
FIG. 2 is a schematic sectional view of an image forming apparatus in Embodiment 1.

FIG. 2 is a schematic sectional view of the image forming apparatus according to the present invention. The image forming apparatus 1 is a four color-based full-color laser printer using the electrophotographic image forming process and forms a color image on a recording paper (recording material) S. The image forming apparatus 1 is of a process cartridge type in which process cartridges P (PY, PM, PC, PK) are detachably mounted in the apparatus main assembly 2 and the color image is formed on the recording paper S.

Here, with respect to the image forming apparatus 1, the side (surface) on which an apparatus openable door 3 is provided is referred to as a front side (surface), and a side (surface) opposite to the front side (surface) is referred to as a rear side (surface). Further, a right side when the image forming apparatus 1 is viewed from the front surface is referred to as a driving side, and a left side is referred to as a non-driving side. FIG. 2 is a sectional view of the image forming apparatus 1 as seen from the non-driving side, in which the front side on the drawing sheet is the non-driving side, the right side on the drawing sheet is the front side (surface), and the rear side on the drawing sheet is the driving side, of the image forming apparatus 1.

In an apparatus main assembly 2, four cartridges P consisting of a first cartridge PY, a second cartridge PM, a third cartridge PC and a fourth cartridge PK are provided and arranged in a horizontal direction. The respective first to fourth cartridges (PY to PK) have the same electrophotographic process mechanism but contain developers (toners) different in color from one another. To the first to fourth cartridges P (PY to PK), a rotational driving force is transmitted from a drive output portion (not shown) of the apparatus main assembly 2. Further, to the first to fourth cartridges P (PY to PK), bias voltages (charging bias, developing bias and the like) are supplied from the apparatus main assembly 2 (not shown).

Each of the first to fourth cartridges P (PY to PK) includes a cleaning unit 8 and a developing device 9. The cleaning unit 8 includes a photosensitive drum 4 and a charging unit and a cleaning device which are used as process means actable on the photosensitive drum 4. The developing device 9 includes a developing means for developing an electrostatic image on the photosensitive drum 4. The cleaning unit 8 and the developing device 9 are connected with each other. As the charging unit, a charging roller 5 is used. As the cleaning device, a cleaning blade 7 is used. As the developing means, a developing roller (developer carrying member) 6 is used. A more specific constitution of the cartridges will be described below.

The first process cartridge PY accommodates the toner of yellow (Y) in its developing device frame 29 and forms the toner image of yellow on the surface of the photosensitive drum 4. The second process cartridge PM accommodates the toner of magenta (M) in its developing device frame 29 and forms the image of magenta on the surface of the photosensitive drum 4. The process third cartridge PC accommodates the toner of cyan (C) in its developing device frame 29 and forms the toner image of cyan on the surface of the photosensitive drum 4. The fourth process cartridge PK accommodates the toner of black (K) in its developing device frame 29 and forms the toner image of black on the surface of the photosensitive drum 4.

Above the first to fourth process cartridges P (PY, PM, PC, PK), a laser scanner unit LB as an exposure means is disposed. This laser scanner unit LB outputs laser light Z correspondingly to image information. Then, the laser light Z passes through an exposure window portion 10 of each cartridge P, so that the surface of the photosensitive drum 4 is subjected to scanning exposure from the laser light Z.

Under the first to fourth cartridges P (PY, PM, PC, PK), an intermediary transfer belt unit 11 as a transfer member is provided. This intermediary transfer belt unit 11 includes a driving roller 13, a tension roller 14 and an assist roller 15, and includes a transfer belt 12 extended and stretched by the rollers. The driving roller 13 is a roller for rotationally driving the transfer belt 12, and the tension roller 14 is a roller for applying tension to the transfer belt 12. The photosensitive drum 4 of each of the first to fourth process cartridges P (PY to PK) is contacted to an upper surface of the transfer belt 12 at its lower surface. A resultant contact portion is a primary transfer portion. At the primary transfer portion, the toner formed on the photosensitive drum 4 is primary-transferred onto the transfer belt 12. Inside the transfer belt 12, primary transfer rollers 16 are disposed opposed to the associated photosensitive drums 4. The primary transfer roller 16 contacts the transfer belt 12 so as to form the primary transfer portion. Oppositely to the tension roller 14, a secondary transfer roller 17 is disposed in contact with the transfer belt 12. A resultant contact portion between the transfer belt 12 and the secondary transfer roller 17 is a secondary transfer portion.

Below the intermediary transfer belt unit 11, a feeding unit 18 is disposed. This feeding unit 18 includes a sheet feeding tray 19 in which sheets of the recording paper S are stacked, and includes a sheet feeding roller 20 and the like.

In an upper left side of the apparatus main assembly 2 in FIG. 2, a fixing unit 21 and a discharging unit 22 are provided. At an upper surface of the apparatus main assembly 2, a sheet discharge tray 23 is disposed.

On the recording paper S, the toner image is fixed by a fixing means provided in the fixing unit 21, and then the recording paper S is discharged onto the discharge tray 23.

The image forming apparatus 1 in this embodiment has the constitution in which the image is formed by the cartridge P which includes the photosensitive drum 4 and the cleaning unit including the charging unit and the developing device and which is detachably mountable to the image forming apparatus 1, but may also have another constitution. For example, the image forming apparatus 1 may also have a constitution in which one or more photosensitive drums 4 and the charging unit are provided in the apparatus main assembly 2 and in which the image is formed by a cartridge P which includes a cleaning unit including a cleaning device and which is detachably mountable to the image forming apparatus 1.

<Image Forming Operation>

An image forming operation for forming a full-color image is as follows. The photosensitive drums 4 of the first to fourth cartridges P (PY to PK) are rotationally driven at a predetermined speed (in the counterclockwise direction in FIG. 2). The transfer belt 12 is also rotationally driven in the same direction (arrow C direction in FIG. 2) as the rotational direction of the photosensitive drums 4 (at their contact portions) at a speed corresponding to the speed of the photosensitive drums 4.

The laser scanner unit LB is also driven. In synchronism with the drive of the laser scanner unit LB, the surface of the photosensitive drum 4 of each cartridge P is uniformly charged to a predetermined polarity and a predetermined potential by the charging roller 5. The laser scanner unit LB scans and exposes the surface of each photosensitive drum 4 with the laser light Z depending on an image signal for an associated color. As a result, the electrostatic latent image depending on the image signal for the associated color is formed on the surface of each photosensitive drum 4. The thus formed electrostatic latent image is developed by the developing roller 6 which is rotationally driven (in the clockwise direction in FIG. 2) at a predetermined speed.

By the electrophotographic image forming process operation as described above, on the photosensitive drum 4 of the first cartridge PY, a yellow toner image corresponding to a yellow component for the full-color image is formed. Then, the toner image is primary-transferred onto the transfer belt 12. Similarly, on the photosensitive drum 4 of the second cartridge PM, a magenta toner image corresponding to a magenta component for the full-color image is formed. Then, the toner image is primary-transferred superposedly onto the yellow toner image which has already been transferred on the transfer belt 12. Similarly, on the photosensitive drum 4 of the third cartridge PC, a cyan toner image corresponding to a cyan component for the full-color image is formed. Then, the toner image is primary-transferred superposedly onto the yellow and magenta toner images which have already been transferred on the transfer belt 12. Similarly, on the photosensitive drum 4 of the fourth cartridge PK, a black toner image corresponding to a black component for the full-color image is formed. Then, the toner image is primary-transferred superposedly onto the yellow, magenta and cyan toner images which have already been transferred on the transfer belt 12.

In this way, unfixed toner images of yellow, magenta, cyan and black for the four color-based full-color image are formed on the transfer belt 12.

On the other hand, at predetermined control timing, sheets of the recording paper S are separated and fed one by one by the sheet feeding roller 20. The recording paper S is fed from the sheet feeding tray 19 toward a downstream portion of the feeding path and then is introduced into the secondary transfer portion which is the contact portion between the secondary transfer roller 17 and the transfer belt 12 with predetermined control timing. As a result, in a process in which the recording paper S is conveyed to the secondary transfer portion, the four color toner images superposed on the transfer belt 12 are collectively transferred onto the surface of the recording paper S.

<Feeding Roller Pair Structure>

Figure 1:
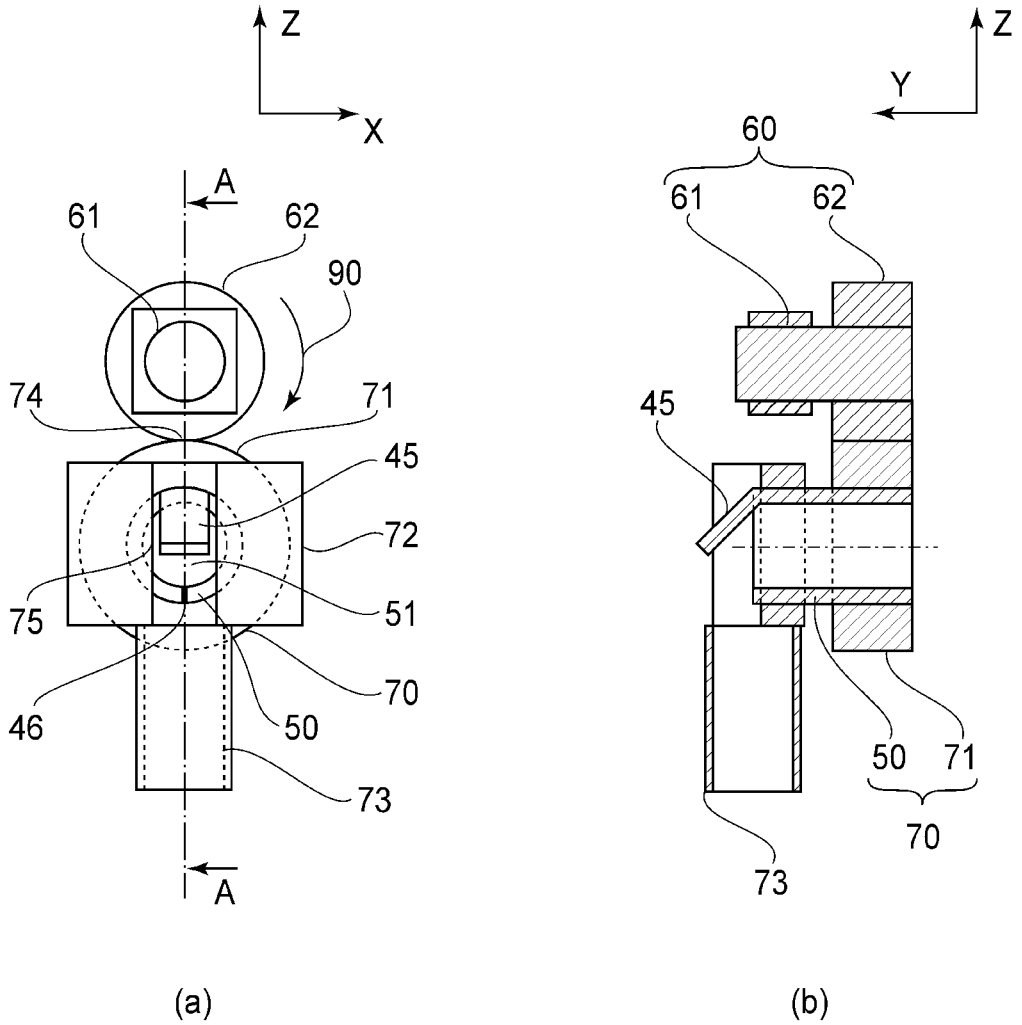
In FIG. 1, (*a*) and (*b*) are schematic views for illustrating a structure of a roller according to Embodiment 1 of the present invention.

In FIG. 1, (*a*) and (*b*) are schematic views showing a specific structure of feeding rollers 60 and 70 in FIG. 2. In FIG. 1, (*a*) is the schematic view of a structure of the feeding rollers 60 and 70 and a peripheral portion thereof as seen in an axial direction of a roller shaft, and (*b*) is a sectional view taken along a line A-A in (*a*) of FIG. 1, wherein (*a*) and (*b*) show the structure only in one end portion side. The structure in the other end portion side is similarly constituted as in one end portion side in a bilaterally symmetrical manner, and therefore will be omitted from description.

The feeding roller 60 as another member in the present invention is constituted by a metal shaft 61 and a rubber portion 62 formed so as to cover an outer peripheral surface of the metal shaft 61. The metal shaft 61 is rotatably supported at end portions thereof by the apparatus main assembly of the image forming apparatus, and is rotationally driven in an arrow 90 direction by a driving source (not shown).

The feeding roller 70 as the roller according to the present invention includes a cylindrical portion 71 as a rotatable cylindrical member and a cylindrical shaft 50 as a cylindrical axis. The cylindrical shaft 50 is a cylindrical shaft member including a joint 46 in at least one position on a circumference thereof. The joint 46 is a separation region where a pair of end portions of the cylindrical shaft 50 with respect to a circumferential direction oppose each other with a slight gap (spacing) or contact each other, and extends in the axial direction of the cylindrical shaft 50. The cylindrical portion 71 is a cylindrical member rotatably mounted around the cylindrical shaft 50 at the outer peripheral surface of the cylindrical shaft 50.

The cylindrical shaft 50 is supported at an end portion thereof by bearings 72 provided in the apparatus main assembly. Each of the bearings 72 is urged by a spring 73, as an urging member provided in the apparatus main assembly, so that the feeding roller 70 is urged against the feeding roller 60. Specifically, an urging force acting so that the cylindrical shaft 50 is caused to approach a contact portion 74 between the feeding rollers 60 and 70 acts from the spring 73 onto the bearing 72 in a direction perpendicular to the shaft (axis). An outer diameter of the cylindrical shaft 50 is smaller than an inner diameter of the cylindrical portion 71, and by the urging force described above, the cylindrical shaft 50 and the cylindrical portion 71 are in a mutually eccentric state, so that an outer peripheral surface of the cylindrical shaft 50 and an inner peripheral surface of the cylindrical portion 71 are in a state in which their surfaces locally contact each other.

At an end portion of the cylindrical shaft 50, a tab portion 45 as an engaging portion is provided. This tab portion 45 engages with a rotation preventing portion 75 provided on the bearing 72, so that rotation of the cylindrical shaft 50 relative to the apparatus main assembly is prevented. The rotation of the cylindrical shaft 50 relative to the apparatus main assembly is prevented at a phase such that the joint 46 is positioned in a side opposite from a side where the cylindrical shaft 50 is urged against the cylindrical portion 71. As a result, the cylindrical portion 71 is constituted so as to rotate around the cylindrical shaft 50 in a region other than the joint 46 of the cylindrical shaft 50 while being press-contacted to the outer peripheral surface of the cylindrical shaft 50. In this way, the rotation of the cylindrical shaft 50 is prevented, so that sliding of the joint 46 of the cylindrical shaft 50 with the cylindrical portion 71 of the feeding roller 70 is suppressed, and therefore a good sliding property can be ensured between the cylindrical shaft 50 and the cylindrical portion 71.

(Effect of Injection of Lubricant)

Figure 3:
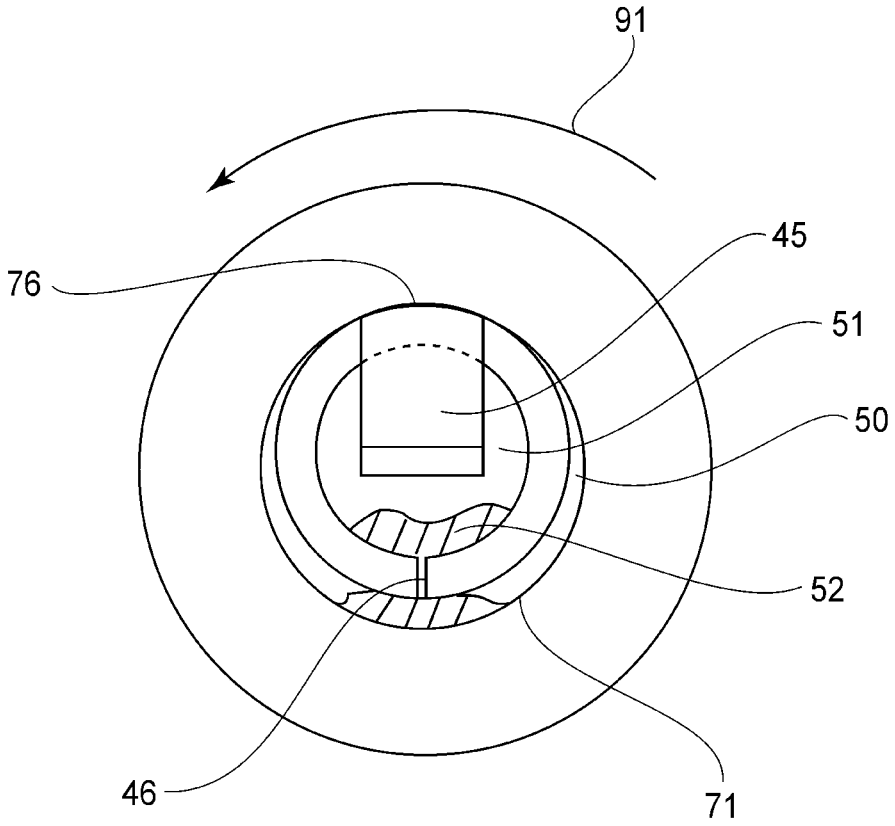
FIG. 3 is a schematic view of the roller in Embodiment 1.

FIG. 3 is an enlarged view of the feeding roller 70 as seen from one side of the axial direction of the feeding roller 70. A lubricant 52 is injected into a hollow portion 51 of the cylindrical shaft 50. The lubricant 52 bleeds out from the joint 46 of the cylindrical shaft 50 to an outside of the cylindrical shaft 50 by a capillary force, so that the lubricant 52 enters the gap between the cylindrical shaft 50 and the cylindrical portion 71. The cylindrical portion 71 is rotated in an arrow 91 direction by rotation of the feeding roller 60. By the rotation of the cylindrical portion 71, the lubricant 52 is continuously supplied to a sliding portion 76 between the cylindrical shaft 50 and the cylindrical portion 71, so that the sliding property between the cylindrical portion 71 and the cylindrical shaft 50 is improved, and thus durability of the feeding roller 70 is improved.

(Cylindrical Shaft Preparing Method)

A manufacturing method of the cylindrical shaft 50 will be specifically described with reference to FIGS. 4 to 7. The cylindrical shaft 50 is roughly manufacturing by molding a metal plate member into a cylindrical shape by subjecting the metal plate member to bending.

Figure 4:
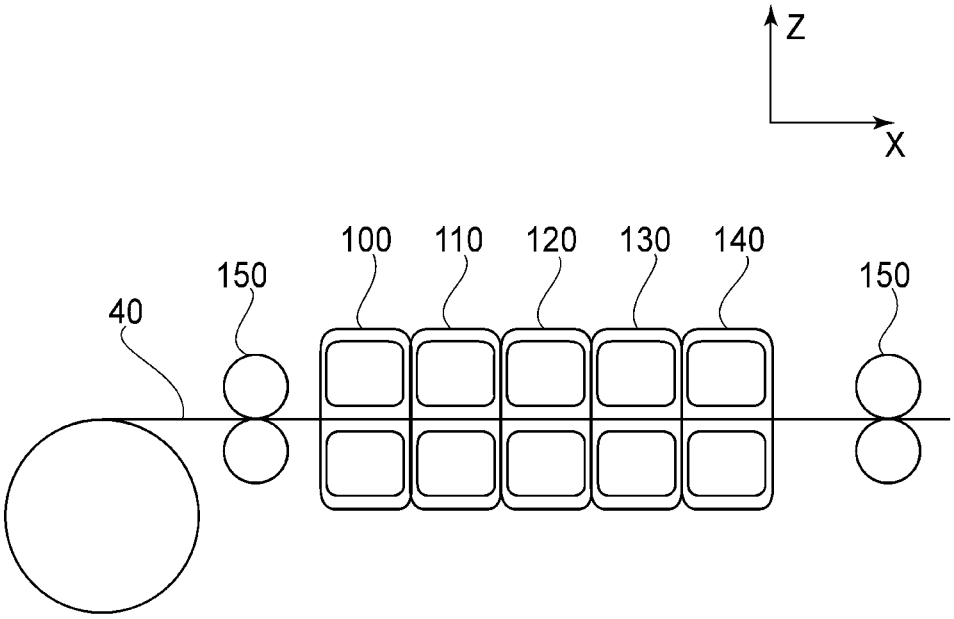
FIG. 4 is a schematic view showing a preparing step of a cylindrical shaft and a structure of a manufacturing apparatus.

FIG. 4 is a schematic view showing a structure of a manufacturing apparatus (device) of the cylindrical shaft 50. The manufacturing apparatus of the cylindrical shaft 50 includes a feeding mechanism 150 for feeding a metal plate 40, a punching processing station 100 for punching the metal plate 40, processing stations 110, 120 and 130 for bending the metal plate 40, and a cutting station 140 for cutting and separating the part.

The metal plate 40 which is rolled in a coil shape and which has a plate thickness of about 0.4-1.2 mm in sent to the punching processing station 100 by bind wound back by the feeding mechanism 150. The punching processing station 100 includes a male mold and a female mold which are used for the punching (processing). In the punching processing station 100, the metal plate 40 is pressed by the male mold and the female mold, so that an unnecessary portion is cut and removed from the metal plate 40 to mold the metal plate 40 into a predetermined shape before the bending (processing).

Figure 5:
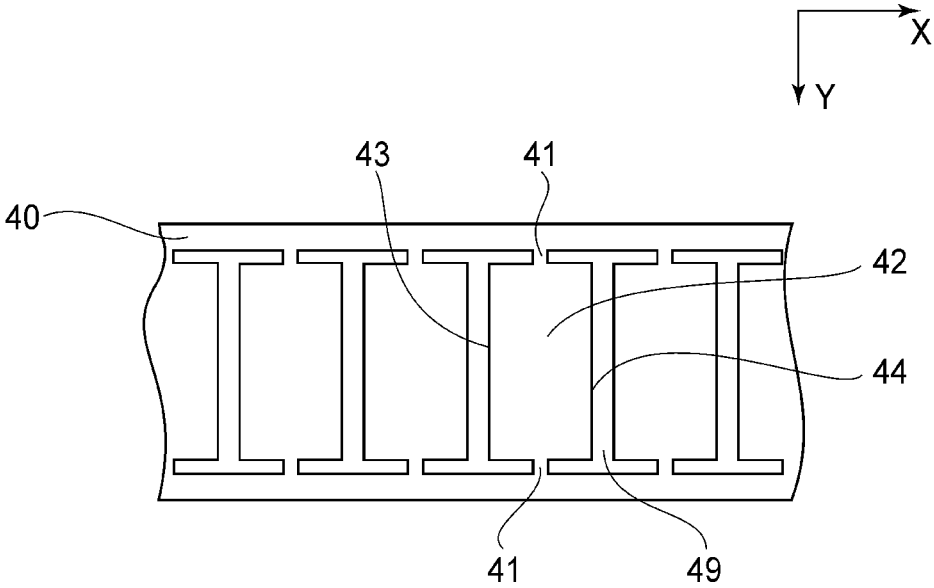
FIG. 5 is a schematic view showing a shape of the metal plate after punching.

FIG. 5 is a schematic view showing a shape of the metal plate 40 after the metal plate 40 passes through the punching processing station 100. The unnecessary portion of the metal plate 40 is cut away and removed so that a plurality of cut-shaped portions 49 which are holes each having an I-shape or an H-shape rotated by 90 degrees are equidistantly formed. By this punching, the metal plate 40 is processed in a shape such that a plurality of flat plate portions 42 contacting the shaft (cylindrical portion) of the cylindrical shaft 50 are connected with a frame portion via connecting portions 41. Edge portions 43 and 44 which are end portions of each flat plate portion 42 with respect to a feeding direction (X direction) of the metal plate 40 are portions constituting joint portions when the flat plate portions 42 are molded into the cylindrical portion by subsequent bending (processing). Further, the connect portions 41 are portions to be cut when each flat plate portion 42 is bent in the cylindrical shape and then is separated from the frame portion, and a portion left in the flat plate portion 42 side after the cutting is a portion constituting the tab portion 45 in a final product state. The metal plate 40 is continuously subjected to the punching by the punching processing station 100, so that a plurality of portions having the above-described shape are equidistantly formed.

Figure 6:
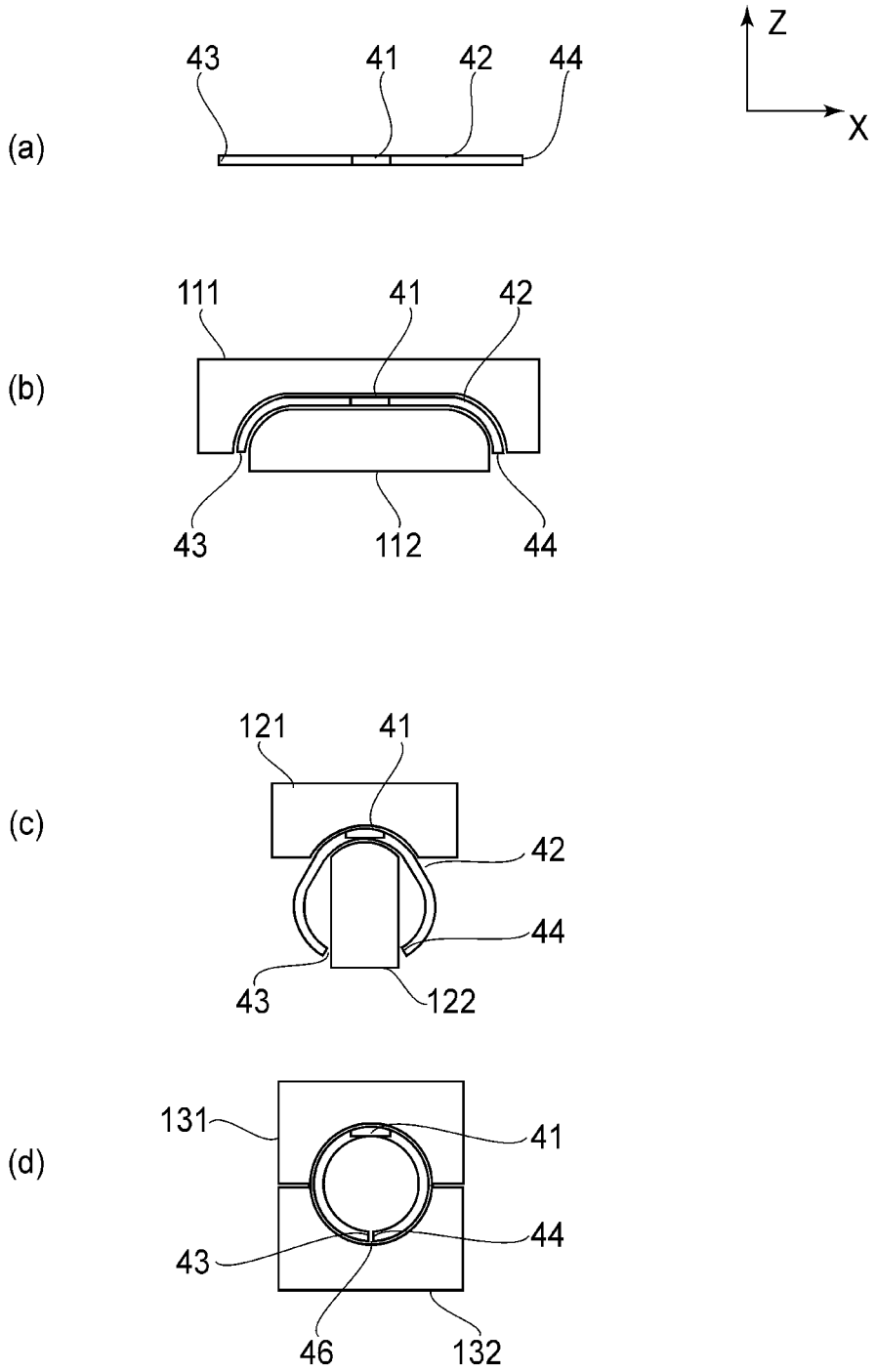
In FIG. 6, (*a*) to (*d*) are schematic views showing bending of the cylindrical shaft.

With reference to FIG. 6, the bending will be described. In FIG. 6, (*a*) to (*d*) are schematic views for illustrating a bending step. The bending processing stations 110 to 130 shown in FIG. 4 are provided and arranged in the feeding direction (X direction) of the metal plate 40.

In FIG. 6, (*a*) is a sectional view of one of the flat plate portions 42 of the metal plate 40 subjected to the punching as seen in the Y direction. This flat plate portion 42 is stepwisely subjected to bending three times by the bending processing stations 110 to 130.

In FIG. 6, (*b*) is the schematic view showing first bending. The first bending is performed by the bending processing station 110. The bending processing station 110 includes a female mold 111 and a male mold 112. The flat plate portion 42 is bent at end portions relative to a central portion so that end surfaces of the edge portions 43 and 44 are directed downwardly by being sandwiched by the female mold 111 and the male mold 112.

In FIG. 6, (*c*) is the schematic view showing second bending. The second bending is performed by the bending processing station 120. The bending processing station 120 includes a female mold 121 and a male mold 122. The flat plate portion 42 bent by the first bending (step) is bent (curved) at the central portion by the female mold 121 and the male mold 122.

In FIG. 6, (*d*) is the schematic view showing third bending. The third bending is performed by the bending processing station 130. The bending processing station 130 includes a female mold 131 and a male mold 132. The flat plate portion 42 bent by the second bending (step) is bent by the female mold 131 and the male mold 132 so that the bent flat plate portion 42 has a substantially cylindrical shape as a whole, and is provided by the female mold 131 and the male mold 122 so that the edge portions 43 and 44 are connected with each other. By the joint 46 through which the edge portions 43 and 44 are connected with each other, the bent flat plate portion 42 has a substantially cylindrical shape. As an example of the joint 46, not only an example in which the edge portions 43 and 44 contact each other but also an example in which the edge portions 43 and 44 oppose each other with a gap (spacing) with respect to a circumferential direction are included. After the above-described bending is ended, the metal plate 40 is in a state in which a plurality of cylindrical shafts 50 are connected with the frame portion by the connecting portions 41.

Figure 7:
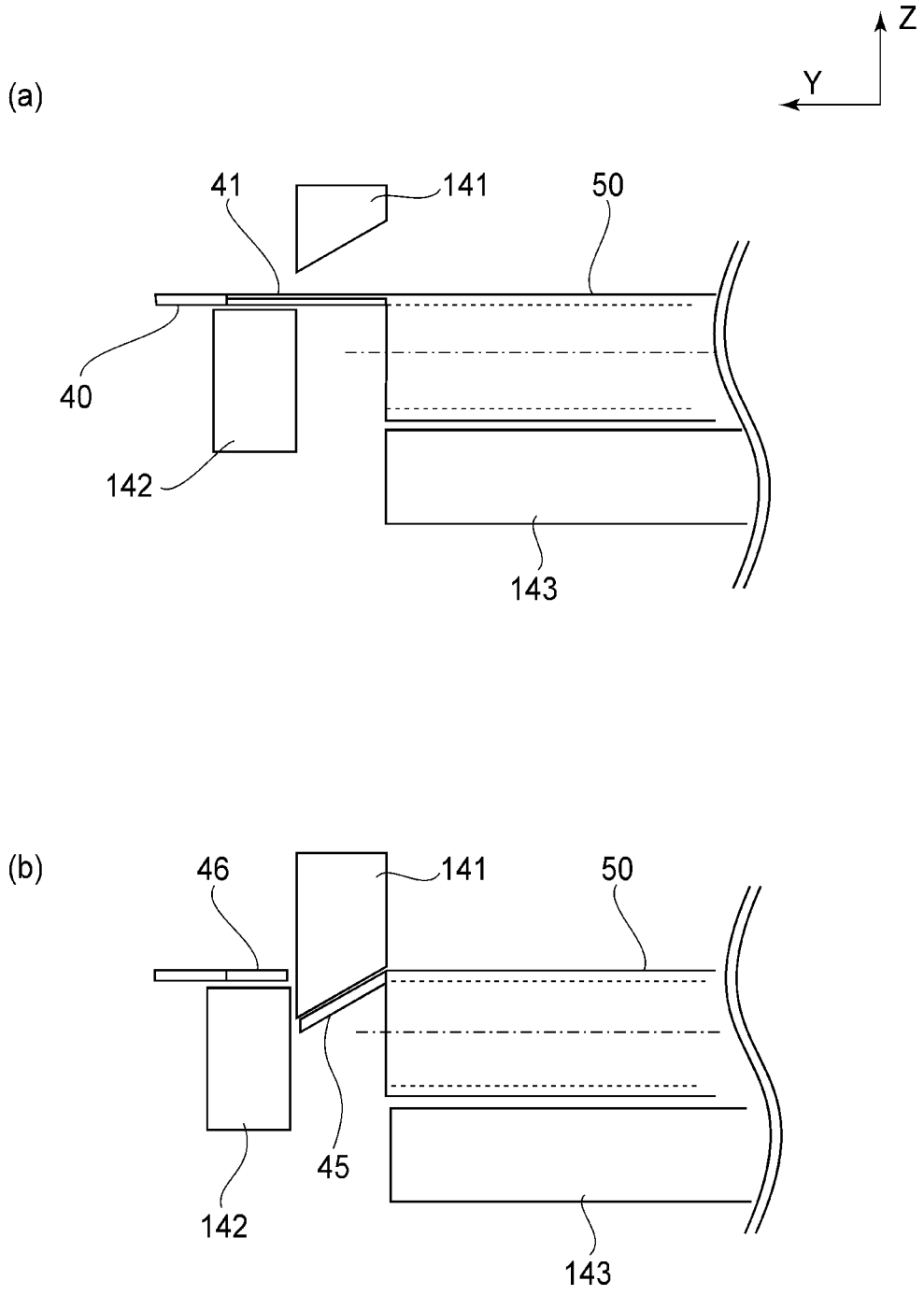
In FIG. 7, (*a*) and (*b*) are schematic views showing a cutting step of the cylindrical shaft.

A cutting step of cutting and separating the cylindrical shaft 50 from the frame portion of the metal plate 40 will be described with reference to FIG. 7. In FIG. 7, (*a*) and (*b*) are schematic views of the metal plate 40 after the end of the bending step as seen in the feeding direction, and are enlarged views showing a periphery of one end portion, particularly in the neighborhood of the connecting portion 41 with respect to a direction perpendicular to the feeding direction of the metal plate 40. A structure of the other end portion is the same as the structure of the one end portion, and therefore will be omitted from description. Further, this step is not only the step of cutting the cylindrical shaft 50 from the frame portion of the metal plate 40 but also a step of molding the metal plate 40 into a final product shape by forming the tab portion 45 at the end portion of the cylindrical shaft 50.

In FIG. 7, (*a*) is the schematic view showing a state immediately before the connecting portion 41 is cut. The cutting step is performed by the cutting station 140. The cutting station 140 includes metal molds 141, 142 and 143.

The metal plate 40 is supported so that a lower side of the cylindrical shaft 50 is supported by the metal mold 143 and a lower side of the connecting portion 41 is supported by the metal mold 142.

In FIG. 7, (*b*) is the schematic view showing a state in which the connecting portion 41 is cut. The connecting portion 41 is cut by lowering the metal mold 141 having a blade at its free end relative to the metal plate 40 supported by the metal molds 142 and 143. The metal mold 141 lowers and approaches the metal mold 142, so that the connecting portion 41 is cut and thus an edge portion 46 connected with the metal plate 40 and the tab portion 45 are formed. Thereafter, by further lowering the metal mold 141, the tab portion 45 is bent toward an axis center direction of the cylindrical shaft 50. That is, when the metal molds 141 and 142 as a pair of tools are moved relative to each other to cut the connecting portion 41, the metal mold 141 is further moved even after the connecting portion 41 is cut while leaving a part of the connecting portion 41 as the tab portion 45 on the cylindrical shaft 50. As a result, the tab portion 45 is bent at a predetermined angle relative to the cylindrical shaft 50.

As described above, according to this embodiment, by employing a constitution in which rotation of the cylindrical shaft 50 relative to the apparatus main assembly is regulated so that the cylindrical shaft 50 and the cylindrical portion 71 rotating relative to each other are press-contacted and slid with each other in a region other than the joint 46, a good sliding property can be obtained. Further, the tab portion 45 is used as a rotation preventing portion for the cylindrical shaft 50 when the cylindrical shaft 50 is processed from the metal plate 40, and thus a manufacturing step of the cylindrical shaft 50 can be simplified so that a manufacturing cost can be reduced. Further, by injecting the lubricant into the cylindrical shaft 50, the lubricant is continuously supplied to the sliding portion between the cylindrical shaft 50 and the cylindrical portion 71, and therefore a good sliding property can be continuously obtained.

(Embodiment 2)

Figure 8:
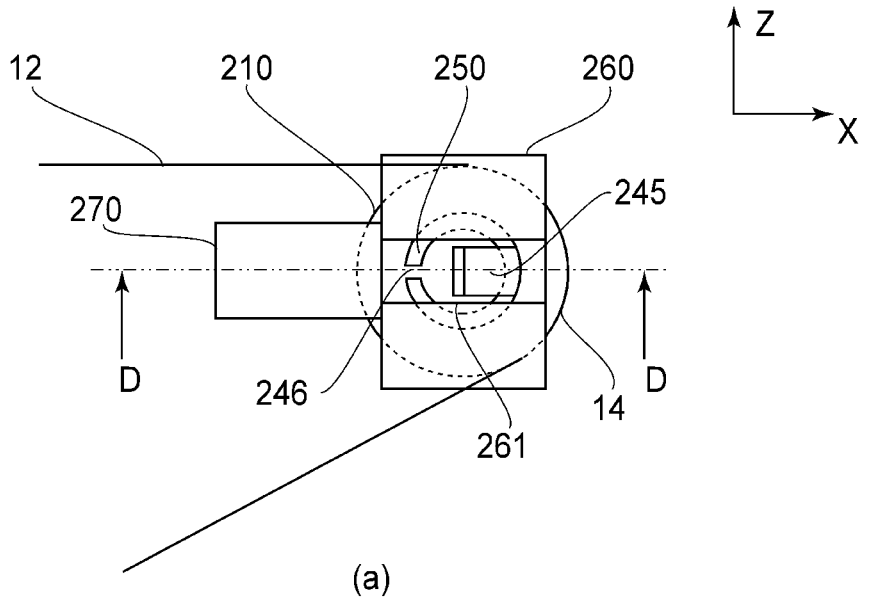
In FIG. 8, (*a*) and (*b*) are schematic views illustrating a structure of a roller according to Embodiment 2 of the present invention.
Figure 8:
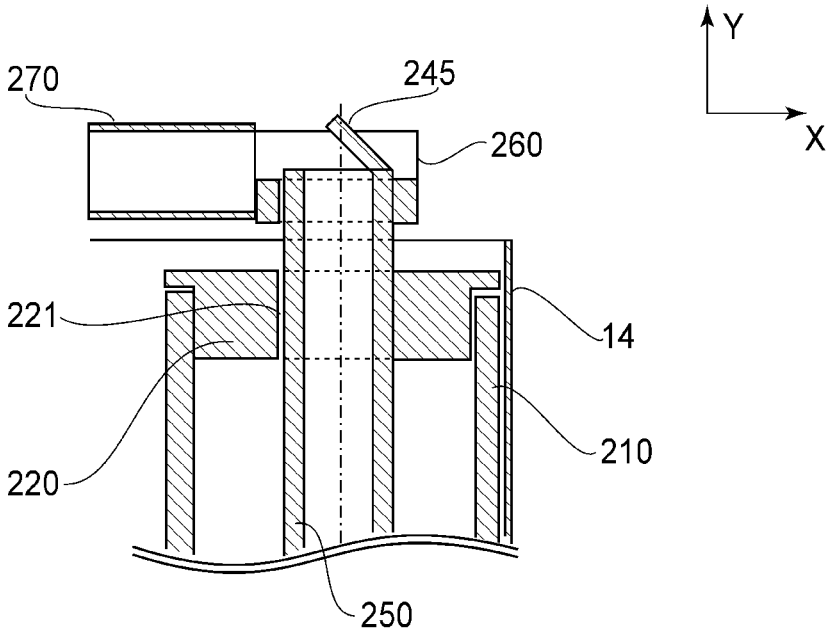

Embodiment 2 of the present invention will be described with reference to FIGS. 2 and 8. In Embodiment 2, a structure of an image forming apparatus and a manufacturing method of a cylindrical shaft are similar to those in Embodiment 1 and therefore will be omitted from description. Further, matters which are not described particularly are similar to those in Embodiment 1. In FIG. 8, (*a*) and (*b*) are schematic views for illustrating a roller in this embodiment, wherein (*a*) is the schematic view showing a structure of a tension roller 14 as the roller in this embodiment and a peripheral portion thereof, and (*b*) is a sectional view taken along a line D-D in (*a*).

As shown in FIG. 2, in the intermediary transfer belt unit 11, the transfer belt 12 for superposing the toner images thereon is stretched by the driving roller 13, the tension roller 14, the assist roller 15 and the primary transfer rollers 16.

As shown in FIG. 8, the tension roller 14 as the roller of the present invention includes a cylindrical member 210 a bearing 220 as a rotatable cylindrical member, and a cylindrical shaft 250 as a cylindrical axis. The bearing 220 is provided at each end portion of the cylindrical shaft 250 with respect to an axial direction of the cylindrical shaft 250 and supports the cylindrical member 210 relative to the cylindrical shaft 250. The bearing 220 is provided with a hole 221 at a center thereof and is rotatably supported by the cylindrical shaft 250 while the end portion of the cylindrical shaft 250 is inserted into the hole 221. The cylindrical member 210 is supported at end portions thereof by the cylindrical shaft 250 via the bearings 220 and is press-contacted at its outer peripheral surface to the transfer belt 12 as another member (belt member) with a predetermined tension. The cylindrical shaft 250 is supported by a tension bearing 260, provided in the apparatus main assembly, at an outside of the end portion bearing 220 with respect to the axial direction. The tension bearing 260 receives an urging force of a tension spring 270 and is constituted such that the tension bearing 260 urges the cylindrical shaft 250 so that the cylindrical member 210 and the bearing 220 are urged toward the transfer belt 12.

The cylindrical shaft 250 is provided with a tab portion 245 as an engaging portion so as to project from an axial direction end portion thereof toward an outside thereof. This tab portion 245 engages with a rotation preventing portion 261 provided on the tension bearing 260, so that rotation of the cylindrical shaft 250 relative to the apparatus main assembly is prevented. Accordingly, during rotation of the tension roller 14, the cylindrical member 210 and the bearing 220 are rotated relative to the cylindrical shaft 250. Further, the cylindrical shaft 250 is in a state in which the cylindrical shaft 250 is pressed against the inner peripheral surface of the hole 221 in a predetermined direction by the tension spring 270, and a region where a degree of the press-contact becomes locally high between the outer peripheral surface of the cylindrical shaft 250 and the inner peripheral surface of the hole 221 is formed. The rotation of the cylindrical shaft 250 relative to the apparatus main assembly is prevented so that a position of a joint portion 246 is a position other than the region where the degree of the press-contact between the cylindrical shaft 250 and the bearing 220 becomes high. Accordingly, sliding of the joint portion 246 of the cylindrical shaft 250 with the hole 221 of the bearing 220 is suppressed.

According to this embodiment, the joint portion 246 does not slide with the bearing 220, and therefore a good sliding property can be obtained between the cylindrical shaft 250 and the bearing 220, so that durability of the tension roller 14 can be enhanced. Further, the tab portion 245 is used as a rotation preventing portion for the cylindrical shaft 250 when the cylindrical shaft 250 is processed from the metal plate, and thus a manufacturing step of the cylindrical shaft 250 can be simplified so that a manufacturing cost can be reduced. Further, similarly as in Embodiment 1, a constitution in which the lubricant is injected into the cylindrical shaft 250, and the lubricant is continuously supplied to the sliding portion between the cylindrical shaft 250 and the bearing 220 through the joint portion 246 may also be employed.

(Embodiment 3)

Figure 9:
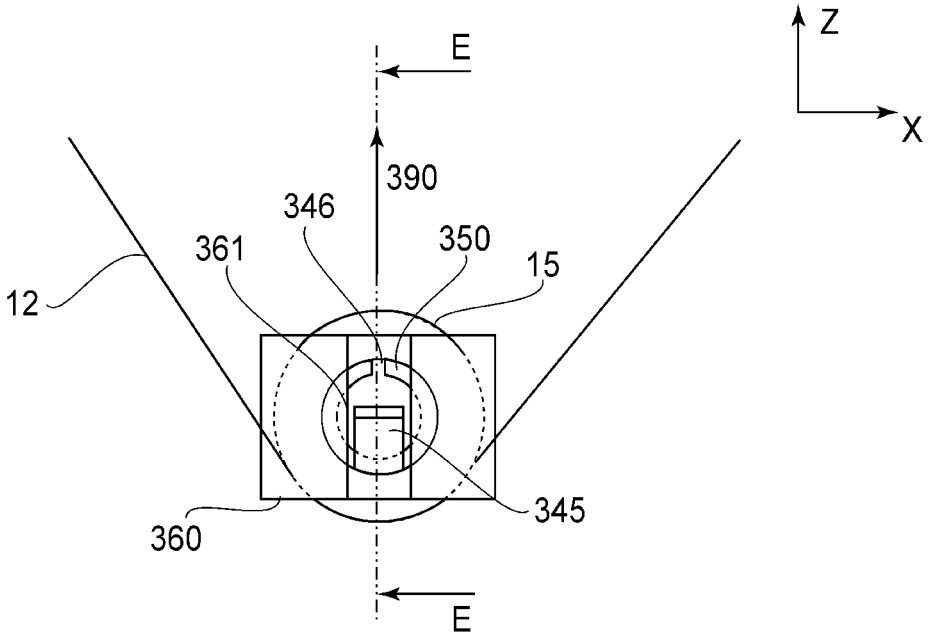
In FIG. 9, (*a*) and (*b*) are schematic views illustrating a structure of a roller according to Embodiment 3 of the present invention.
Figure 9:
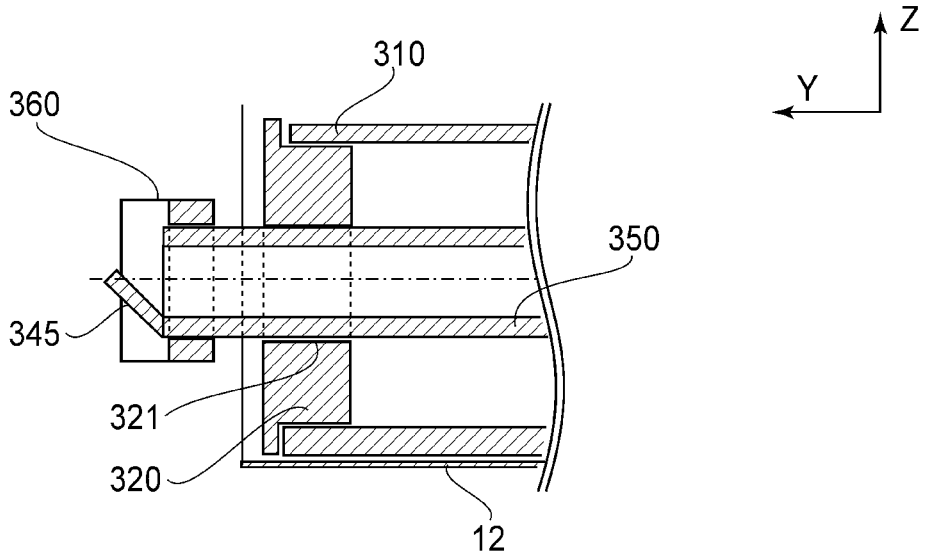

Embodiment 3 of the present invention will be described with reference to FIG. 9. In Embodiment 3, a structure of an image forming apparatus and a manufacturing method of a cylindrical shaft are similar to those in Embodiment 1 and therefore will be omitted from description. Further, matters which are not described particularly are similar to those in Embodiment 1. In FIG. 9, (*a*) and (*b*) are schematic views for illustrating a roller in this embodiment, wherein (*a*) is the schematic view showing a structure of an assist roller 15 as the roller in this embodiment and a peripheral portion thereof, and (*b*) is a sectional view taken along a line E-E in (*a*).

As shown in FIG. 9, the assist roller 15 as the roller of the present invention includes a cylindrical member 310, a bearing 320 as a rotatable cylindrical member, and a cylindrical shaft 350 as a cylindrical axis. The bearing 320 is provided at each end portion of the cylindrical shaft 350 with respect to an axial direction of the cylindrical shaft 350 and supports the cylindrical member 310 relative to the cylindrical shaft 350. The bearing 320 is provided with a hole 321 at a center thereof and is rotatably supported by the cylindrical shaft 350 while the end portion of the cylindrical shaft 350 is inserted into the hole 321. The cylindrical member 310 is supported at end portions thereof by the cylindrical shaft 350 via the bearings 320 and is press-contacted at its outer peripheral surface to the transfer belt 12 as another member (belt member) with a predetermined tension. This tension is applied by the tension roller 14. That is, the tension roller 14 exerts the tension on the transfer belt 12 as described above, so that an urging force acts from the transfer belt 12 onto the assist roller 15 in an arrow 390 direction.

The cylindrical shaft 350 is supported by an assist roller bearing 360, provided in the apparatus main assembly, at an outside of the end portion bearing 320 with respect to the axial direction. The cylindrical shaft 350 is provided with a tab portion 345 as an engaging portion so as to project from an axial direction end portion thereof toward an outside thereof. This tab portion 345 engages with a rotation preventing portion 361 provided on the assist roller bearing 360, so that rotation of the cylindrical shaft 350 relative to the apparatus main assembly is prevented. Accordingly, during rotation of the assist roller 15, the cylindrical member 310 and the bearing 320 are rotated relative to the cylindrical shaft 350. Further, the cylindrical shaft 350 is in a state in which the cylindrical shaft 350 is pressed against the inner peripheral surface of the hole 321 in the arrow 390 direction by the tension applied from the tension roller 14 to the transfer belt 12. Therefore, a region where a degree of the press-contact becomes locally high between the outer peripheral surface of the cylindrical shaft 350 and the inner peripheral surface of the hole 321 is formed. The rotation of the cylindrical shaft 350 relative to the apparatus main assembly is prevented so that a position of a joint portion 346 is a position other than the region where the degree of the press-contact between the cylindrical shaft 350 and the bearing 320 becomes high. Accordingly, sliding of the joint portion 346 of the cylindrical shaft 350 with the hole 321 of the bearing 320 is suppressed.

According to this embodiment, the joint portion 346 does not slide with the bearing 320, and therefore a good sliding property can be obtained between the cylindrical shaft 350 and the bearing 320, so that durability of the assist roller 15 can be enhanced. Further, the tab portion 345 is used as a rotation preventing portion for the cylindrical shaft 350 when the cylindrical shaft 350 is processed from the metal plate, and thus a manufacturing step of the cylindrical shaft 350 can be simplified, and the assist roller 15 can be reduced in weight so that a manufacturing cost can be reduced.

(Other Embodiments)

As a material for the rotatable cylindrical member, e.g., a resin material is used but is appropriately selected depending on the uses of the roller and the sliding property with the metal shaft, and therefore is not particularly limited. Further, an inner diameter of the rotatable cylindrical member is set so as to be larger than an outer diameter of the cylindrical shaft, but a specific difference in dimension is appropriately set depending on specification or the like of the roller, and therefore is not particularly limited. That is, a constitution in which an eccentric state is formed in a condition in which a load is applied between the cylindrical shaft and the rotatable cylindrical member with respect to a certain direction and a state in which the joint portion does not contact the rotatable cylindrical is formed may only be required to be employed.

The engaging portion is not limited to the structure described in the above embodiments so long as a rotation preventing function can be performed. As the structure in which the engaging portion projects from the end portion of the cylindrical shaft toward an outside with respect to the axial direction, e.g., the engaging portion may project straightly along the axial direction or may projects in an oblique direction toward the outside with respect to a radial direction. However, in consideration of influences on a mounting property on the bearing of the cylindrical shaft and rotation of the rotatable cylindrical member, the engaging portion may preferably inwardly incline with respect to the radial direction. Further, the engaging portion is caused to project inwardly toward the center axis of the cylindrical shaft with respect to the radial direction, whereby a point where a force is applied to the cylindrical shaft when the rotation is stopped approaches the center of the cylindrical shaft, so that attitude during an operation is stabilized.

Also with respect to the structure of the joint portion, the structure is not limited to the structure, described in the above embodiments, in which the joint portion extends straightly from an end to the other end of the cylindrical portion in the axial direction. For example, the present invention is also applicable to even a constitution in which the joint portion helically extends in a predetermined range of the cylindrical shaft with respect to the circumferential direction or a constitution in which an extension direction of the joint portion changes partway. Further, the present invention is also applicable to even a constitution in which a plurality of joint portions are formed by connecting a plurality of curved members each having a straight forward shape to form the curved members into a cylindrical shape.

Figure 10:
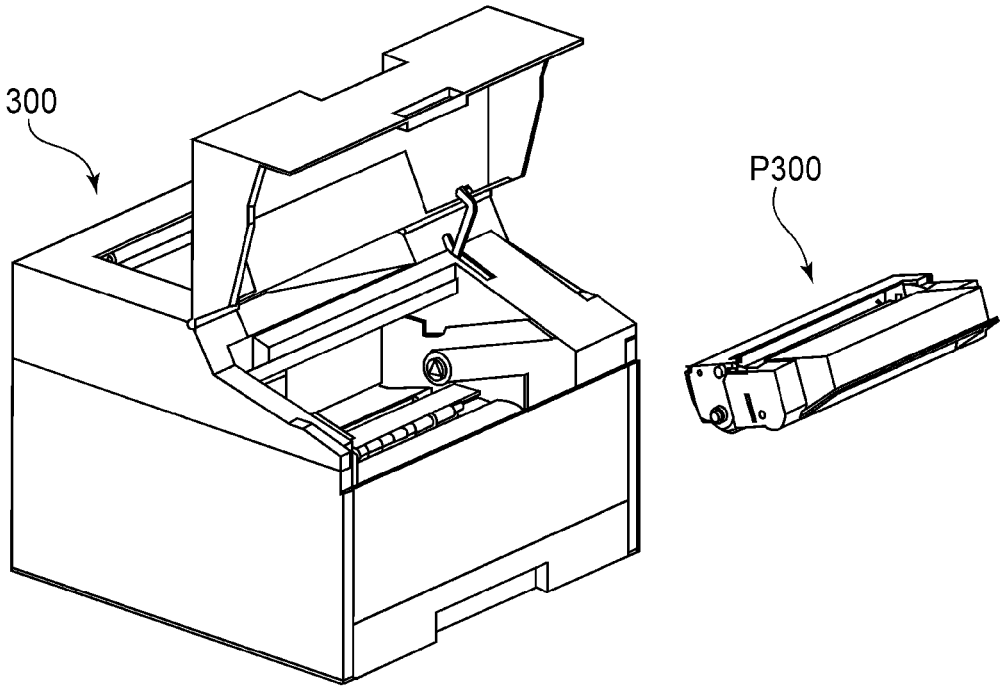
FIG. 10 is a schematic perspective view of an image forming apparatus according to another embodiment of the present invention.

In the above embodiments, the case where the present invention is applied to the roller to be mounted in the apparatus main assembly was described, but the present invention can also be applied to a roller provided in each of the cartridges PY, PM, PC and PK each detachably mountable to the image forming apparatus 1 shown in FIG. 2. The present invention can also be applied to a roller provided in a cartridge P300 detachably mountable to an apparatus main assembly 300 shown in FIG. 10.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 017263/2014 filed Jan. 31, 2014, which is hereby incorporated by reference.

What is claimed is:

1. A roller provided in a main assembly of an image forming apparatus or provided in a cartridge detachably mountable to the main assembly, the roller comprising:

a cylindrical shaft supported by the main assembly or the cartridge, wherein the cylindrical shaft includes, in at least one location on a circumference of the cylindrical shaft, a separation region where a pair of end portions of the cylindrical shaft are located such that the end portions oppose each other or are in contact with each other with respect to a circumferential direction relative to the circumference of the cylindrical shaft, and wherein the separation region extends in an axial direction of the cylindrical shaft; and a rotatable cylindrical member mounted around an outer circumference of the cylindrical shaft, wherein the rotatable cylindrical member is rotatable about the cylindrical shaft while an inner peripheral surface of the rotatable cylindrical member is in contact with an outer peripheral surface of the cylindrical shaft in a region of the cylindrical shaft other than the separation region with respect to the circumferential direction.

2. A roller according to claim 1, further comprising an urging member for urging the cylindrical shaft, wherein the separation region is located such that it opposes the urging member with respect to the rotatable cylindrical member.

3. A roller according to claim 2, wherein the rotatable cylindrical member contacts a second rotatable member, with the second rotatable member being supported at an outer peripheral surface of the second rotatable member by the main assembly or the cartridge, wherein the urging member is provided in the main assembly or the cartridge, and wherein the cylindrical shaft is urged by the urging member in a direction toward a contact portion between the rotatable cylindrical member and the second rotatable member.

4. A roller according to claim 1, wherein the inner peripheral surface of the rotatable cylindrical member is in contact with the separation region of the cylindrical shaft at a portion of the rotatable cylindrical member that is opposed to the separation region.

5. A roller according to claim 1, wherein the cylindrical shaft includes an engaging portion engageable with a rotation preventing portion provided in the main assembly or the cartridge.

6. A roller according to claim 5, wherein the engaging portion is provided at an end portion of the cylindrical shaft with respect to an axial direction of the cylindrical shaft.

7. A roller according to claim 6, wherein the engaging portion projects outwardly from the end portion of the cylindrical shaft in the axial direction of the cylindrical shaft.

8. A roller according to claim 7, wherein the engaging portion projects obliquely with respect to the axial direction of the cylindrical shaft.

9. A roller according to claim 8, wherein the engaging portion projects obliquely from the end portion of the cylindrical shaft toward a center axis of the cylindrical shaft with respect to the axial direction of the cylindrical shaft.

10. A roller according to claim 5, wherein the engaging portion is provided, at a location corresponding to a contact portion between the cylindrical shaft and the rotatable cylindrical member, at an end portion of the cylindrical shaft with respect to an axial direction of the cylindrical shaft.

11. A roller according to claim 5, wherein the cylindrical shaft is formed by bending a metal plate, including a frame portion, a flat plate portion and a connecting portion connecting the frame portion and the flat plate portion, into a cylindrical shape at the flat plate portion and then by separating the flat plate portion from the frame portion by cutting the connecting portion such that a part of the connecting portion provides the engaging portion at an end portion of the flat plate portion.

12. A roller according to claim 11, wherein the engaging portion is formed by moving a pair of tools relative to the connecting portion such that the part of the connecting portion at the end portion of the flat plate portion inclines with respect to an axial direction of the cylindrical shaft when the connecting portion is cut by moving the pair of tools relative to the connecting portion.

13. A roller according to claim 1, wherein the cylindrical shaft is formed by bending a metal plate into a cylindrical shape.

14. A roller according to claim 1, wherein a lubricant is supplied to an inside of a cylindrical portion of the cylindrical shaft and bleeds out to an outside of the cylindrical portion through the separation region.

15. A roller according to claim 1, wherein the roller feeds a recording material in the image forming apparatus.

16. A roller according to claim 1, wherein the roller stretches an endless belt in the image forming apparatus.

17. An image forming apparatus comprising:

a cylindrical shaft supported by a main assembly or a cartridge, wherein the cylindrical shaft includes, in at least one location on a circumference of the cylindrical shaft, a separation region where a pair of end portions of the cylindrical shaft are located such that the end portions oppose each other or are in contact with each other with respect to a circumferential direction relative to the circumference of the cylindrical shaft, and wherein the separation region extends in an axial direction of the cylindrical shaft;

a rotatable cylindrical member mounted around an outer circumference of the cylindrical shaft, wherein the rotatable cylindrical member is rotatable about the cylindrical shaft while an inner peripheral surface of the rotatable cylindrical member is in contact with an outer peripheral surface of the cylindrical shaft with respect to the circumferential direction in a region of the cylindrical shaft other than the separation region; and an urging member for urging the cylindrical shaft, wherein the separation region is located such that it opposes the urging member with respect to the rotatable cylindrical member.

18. A manufacturing method of a cylindrical shaft that includes a roller provided in a main assembly of an image forming apparatus or in a cartridge detachably mountable to the main assembly, wherein the cylindrical shaft includes, in at least one location on a circumference of the cylindrical shaft, a separation region in which a pair of end portions of the cylindrical shaft are located such that the end portions oppose each other or are in contact with each other with respect to a circumferential direction of the cylindrical shaft, wherein the cylindrical shaft is supported in the main assembly or in the cartridge by a support, the support extending in an axial direction of the cylindrical shaft, wherein a rotatable cylindrical member is rotatably mounted around an outer circumference of the cylindrical shaft, and wherein the cylindrical shaft further includes an engaging portion engageable with a rotation preventing portion provided in the main assembly or the cartridge, the manufacturing method comprising:

a bending step of bending a metal plate, including a frame portion, a flat plate portion and a connecting portion connecting the frame portion and the flat plate portion, into a cylindrical shape at the flat plate portion; and a cutting step of separating the flat plate portion, formed into the cylindrical shape, from the frame portion in order to form a part of the connecting portion as the engaging portion at an end portion of the flat plate portion formed in the cylindrical shape.

19. A manufacturing method according to claim 18, wherein in the cutting step, when the connecting portion is cut by moving a pair of tools relative to the connecting portion, the pair of tools is moved relative to the connecting portion such that the part of the connecting portion that forms the engaging portion at the end portion of the flat plate portion inclines with respect to the axial direction of the cylindrical shaft.

* * * * *